United States Patent [19]

Matsushima

[11] Patent Number: 4,811,644

[45] Date of Patent: Mar. 14, 1989

[54] ELECTRONIC MUSICAL INSTRUMENT FOR GENERATION OF INHARMONIC TONES

[75] Inventor: Tadashi Matsushima, Shizuoka, Japan

[73] Assignee: Kabushiki Kaisha Kawai Gakki Seisakusho, Japan

[21] Appl. No.: 129,423

[22] Filed: Nov. 25, 1987

Related U.S. Application Data

[63] Continuation of Ser. No. 831,661, Feb. 20, 1986, abandoned.

[30] Foreign Application Priority Data

Feb. 26, 1985 [JP] Japan ..... 60-037282

[51] Int. Cl.[4] ..... G10H 1/08; G10H 7/00

[52] U.S. Cl. ..... 84/1.2; 84/1.22; 84/1.23

[58] Field of Search ..... 84/1.01, 1.19–1.23; 364/419, 718, 721

[56] References Cited

U.S. PATENT DOCUMENTS 3,809,786 5/1974 Deutsch .
3,809,789 5/1974 Deutsch .
3,888,153 6/1975 Deutsch .
3,992,970 11/1976 Chibana et al. .
3,994,195 11/1976 Chibana et al. .
4,082,028 4/1978 Deutsch .
4,132,140 1/1979 Chibana .
4,135,422 1/1979 Chibana ..... 84/1.01
4,150,600 4/1979 Deutsch .
4,175,464 11/1979 Deutsch .
4,205,577 6/1980 Deutsch .
4,223,583 9/1980 Deutsch .
4,256,004 3/1981 Takeuchi .
4,301,704 11/1981 Nagai et al. .
4,444,082 4/1984 Whitefield .

*Primary Examiner*—Stanley J. Witkowski
*Attorney, Agent, or Firm*—McGlew & Tuttle

[57] ABSTRACT

The present invention is directed to an electronic musical instrument which has a circuit for calculating a harmonic function corresponding to a fundamental wave. The electronic musical instrument is provided with a circuit for generating, as the harmonic function, an in-tune function corresponding to an in-tune harmonic, a circuit for generating a phase function which imparts an arbitrary frequency number log to the in-tune harmonic and a circuit for multiplying the in-tune function and the phase function, whereby a tone close to a natural tone of an acoustic musical instrument can be created at a relatively low cost.

4 Claims, 3 Drawing Sheets

ELECTRONIC MUSICAL INSTRUMENT FOR GENERATION OF INHARMONIC TONES

RELATED APPLICATION INFORMATION

This application is a file wrapper continuation of application Ser. No. 831,661, filed Feb. 20, 1986, now abandoned.

BACKGROUND OF THE INVENTION

1. Field of the Invention

The present invention relates to an electronic musical instrument which creates a musical tone having inharmonics in by calculating harmonic functions corresponding to a fundamental wave of the musical tone.

2. Description of the Prior Art

Conventional harmonic-synthesis methods for synthesizing harmonic functions corresponding to a fundamental wave generally handle integral harmonics alone. A sine-wave synthesis method, which is one of the prior art synthesis methods, can also produce only a synthesized tone which is far from an acoustic musical tone. To create an inharmonic which is contained in the acoustic musical tone through the use of the sine-wave synthesis method, it is necessary to use oscillators in an equal in number to the harmonics desired. This, however, is almost impractical from the economical point of view. On this account, low-cost, popular versions of electronic musical instruments do not employ such a method but instead generate harmonics through the use of a nonreal time method and, as a result, produce only musically unsatisfactory tones.

Tones of the stringed instruments, which are acoustic musical instruments, contain a second harmonic having a wavelength that is one-half that of the fundamental wave which is equal to the length of the string, a third harmonic having a wavelength that is one-third that of the fundamental wave, . . . and, on top of that, a few hundredth harmonics. In addition, they have the inherent "inharmonicity" that the high order harmonics further shift toward higher frequencies as frequency rises. This makes the tones of the stringed instruments metallic or brilliant.

SUMMARY OF THE INVENTION

It is an object of the present invention to provide an electronic musical instrument which is designed to create the same tone as that of an acoustic musical instrument by synthesizing a frequency spectrum which has the same inharmonicity as that the tone of the acoustic musical instrument and sine waves which have a harmonic envelope which is a temporal variation of harmonic power.

To attain the above object, the electronic musical instrument of the present invention, which has a means for calculating harmonics corresponding to the fundamental wave and synthesizes a musical waveform, is characterized by a means for generating, as the harmonics, a harmonic function corresponding to a harmonic, a means for generating a phase function which causes an arbitrary frequency difference in the harmonic, and a means for multiplying the harmonic function and the phase function, whereby an inharmonic is created.

DESCRIPTION OF THE PREFERRED EMBODIMENTS

Figure 2A:
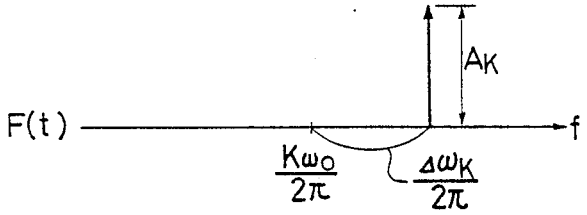
FIGS. 2A, 2B and 2C are schematic diagrams for explaining the principles of the present invention.
Figure 2B:
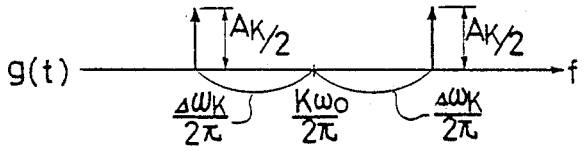
Figure 2C:
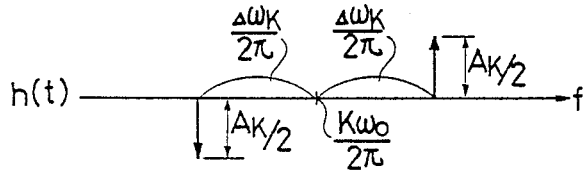

FIGS. 2A through 2C show spectral configurations for the following expanded expressions (1) to (3) of harmonic functions in the present invention:

$$\begin{aligned} F(t) &= \sum_{K=1}^{n} A_K \sin[K\omega_0 + \Delta\omega_K]t \\ &= \sum_{K=1}^{n} A_K[\sin K\omega_0 t \cdot \cos\Delta\omega_K t + \cos K\omega_0 t \cdot \sin\Delta\omega_K t] \\ &= \sum_{K=1}^{n} A_K \cdot \sin K\omega_0 t \cdot \cos\Delta\omega_K t + \\ &\quad \sum_{K=1}^{n} A_K \cos K\omega_0 t \cdot \sin\Delta\omega_K t \end{aligned} \tag{1}$$

$$\begin{aligned} g(t) &= \sum_{K=1}^{n} A_K \cdot \sin K\omega_0 t \cdot \cos\Delta\omega_K t \\ &= \tfrac{1}{2} \sum_{K=1}^{n} A_K[\sin(K\omega_0 + \Delta\omega_K)t + \sin(K\omega_0 - \Delta\omega_K)t] \end{aligned} \tag{2}$$

$$\begin{aligned} h(t) &= \sum_{K=1}^{n} A_K \cos K\omega_0 t \cdot \sin\Delta\omega_K t \\ &= \tfrac{1}{2} \sum_{K=1}^{n} A_K[\sin(K\omega_0 + \Delta\omega_K)t - \sin(K\omega_0 - \Delta\omega_K)t] \end{aligned} \tag{3}$$

where t is time, $A_K$ is amplitude, $\omega_0$ is the harmonic frequency ($\omega_0/2\pi$) and $\Delta\omega_K$ is a frequency number difference ($\Delta\omega_K/2\pi$). When the function F(t) is defined as in the expression (1), it is an over tone having up to an nth inharmonic. The frequency spectrum of its Kth inharmonic is such as shown in FIG. 2A, which is deviated to a frequency higher than that $K\omega_0/2\pi$ [Hz] of the corresponding harmonic by $\Delta\omega_K/2\pi$ [Hz].

Using the addition theorem for a trigonometric function, F(+) can be represented by g(t) and h(t), respectively. g(t) and h(t) are transformed as given in the expressions (2) and (3), and for them, positive and negative spectra, each having a one-half amplitude, will appear at frequencies $\Delta\omega_K/2\pi$ [Hz] apart from the carrier frequency $K\omega_0/2\pi$ [Hz] of the corresponding harmonic on both lower and higher sides thereof, as depicted in FIGS. 2B and 2C. Accordingly, it will be seen that the spectrum shown in FIG. 2A can be obtained by adding together the abovesaid g(t) and h(t).

Figure 3:
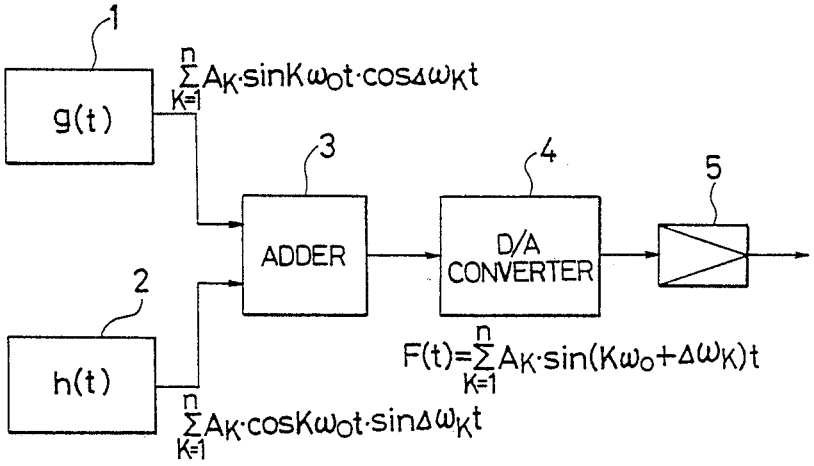
FIG. 3 is a block diagram for explaining the principles of the present invention.

FIG. 3 illustrates in block form the principles of generation of the over tones shown in FIGS. 2A to 2C. In FIG. 3, reference numeral 1 indicates a device for obtaining the expression (2), i.e. a device for generating, up to an nth order, a signal obtained by amplitude modulating a harmonic of a sine wave with a cosine wave. Reference numeral 2 identifies a device for obtaining the expression (3), i.e., a device for generating, up to an nth order, a signal obtained by amplitude modulating a harmonic of a cosine wave with a sine wave. $A_K$ is a harmonic coefficient representing the amplitude for each signal, and it can be freely set in the above devices.

The signals available from the g(t) device 1 and the h(t) device 2 are added together by an adder 3 and the resulting over tone F(t) is converted by a D/A converter 4 to analog form. The converted output is provided to a sound system 5.

In this instance, the modulated waves g(t) and h(t), which are produced by the devices 1 and 2 on a real or nonreal time basis, are added together by the adder 3, thereby obtaining the over tone F(t).

Figure 1:
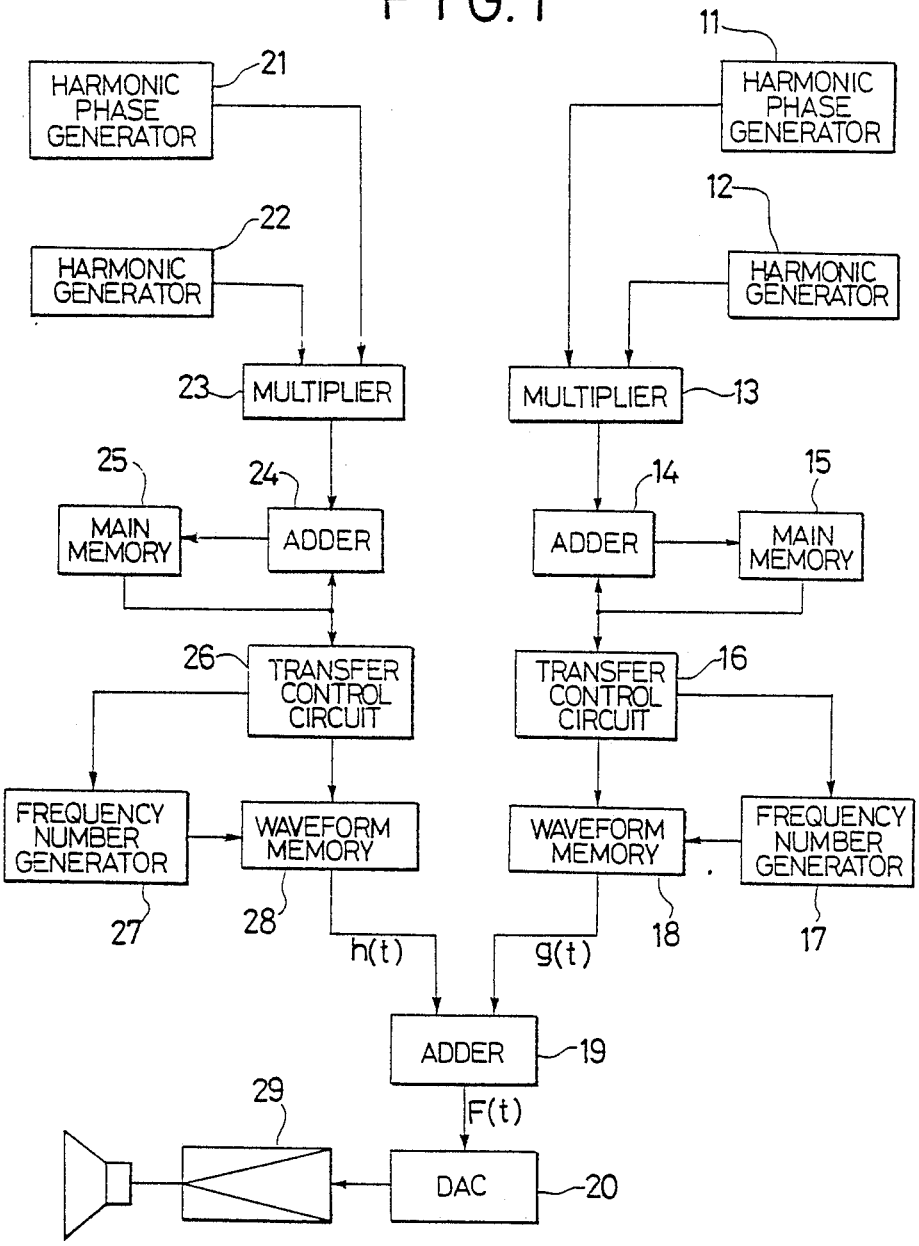
FIG. 1 is a block diagram illustrating the arrangement of an embodiment of the present invention.

FIG. 1 illustrates in block form a specific example of the basic arrangement of the present invention depicted in FIG. 3. In FIG. 1 a harmonic-phase generator 11 generates cos $\Delta\omega_K t$ in the expression (2) and a harmonic generator 12 sin $K\omega_0 t$ in the expression (2). The signals created by the generators 11 and 12 are multiplied by a multiplier 13, performing a modulation. The multiplied output is applied to a circuit which comprises an adder 14 and a main memory 15 and in which the output of the latter is provided to the former. In this circuit, harmonic components from the fundamental wave and the nth order harmonics are added together to create a musical waveform, and the waveform signal thus produced is stored in the main memory 15. The waveform signal is transferred to a waveform memory 18 under control of a transfer-control circuit 16. A frequency number generator 17 is used to add a frequency to the signal transferred to the waveform memory 18.

On the other hand, a harmonic-phase generator 21 generates sin $\Delta\omega_K t$ in the expression (3) and a harmonic generator 22 generates cos $K\omega_0 t$ in the expression (3). The signals created by the generators 21 and 22 are multiplied by a multiplier 23, carrying out a modulation. The arrangement from an adder 24 to a waveform memory 28 has the same functions as those of the above-described arrangement from the adder 14 to the waveform memory 18. These arrangements can be implemented on either the real or nonreal time basis, and the adders 14 and 24 may also be additionally equipped with the function of a controller for a harmonic envelope. It is also possible, for improving the system efficiency, to design the harmonic-phase generators 11 and 21 and the harmonic generators 12 and 22 so that they function compatibly with each other, and to eliminate either one of the two systems from the harmonic-phase generators 11 and 21 to the waveform memories 18 and 28 and to use the remaining system on a time-shared basis.

The modulated waves g(t) and h(t) created by the above two systems are provided as the outputs of the waveform memories 18 and 28 to an adder 19, wherein they are added together, producing an over tone F(t), as described previously in connection with FIGS. 2A through 2C. The over tone F(t) is then converted by a D/A converter 20 to an analog signal, which is applied to a sound system 29.

Figure 4:
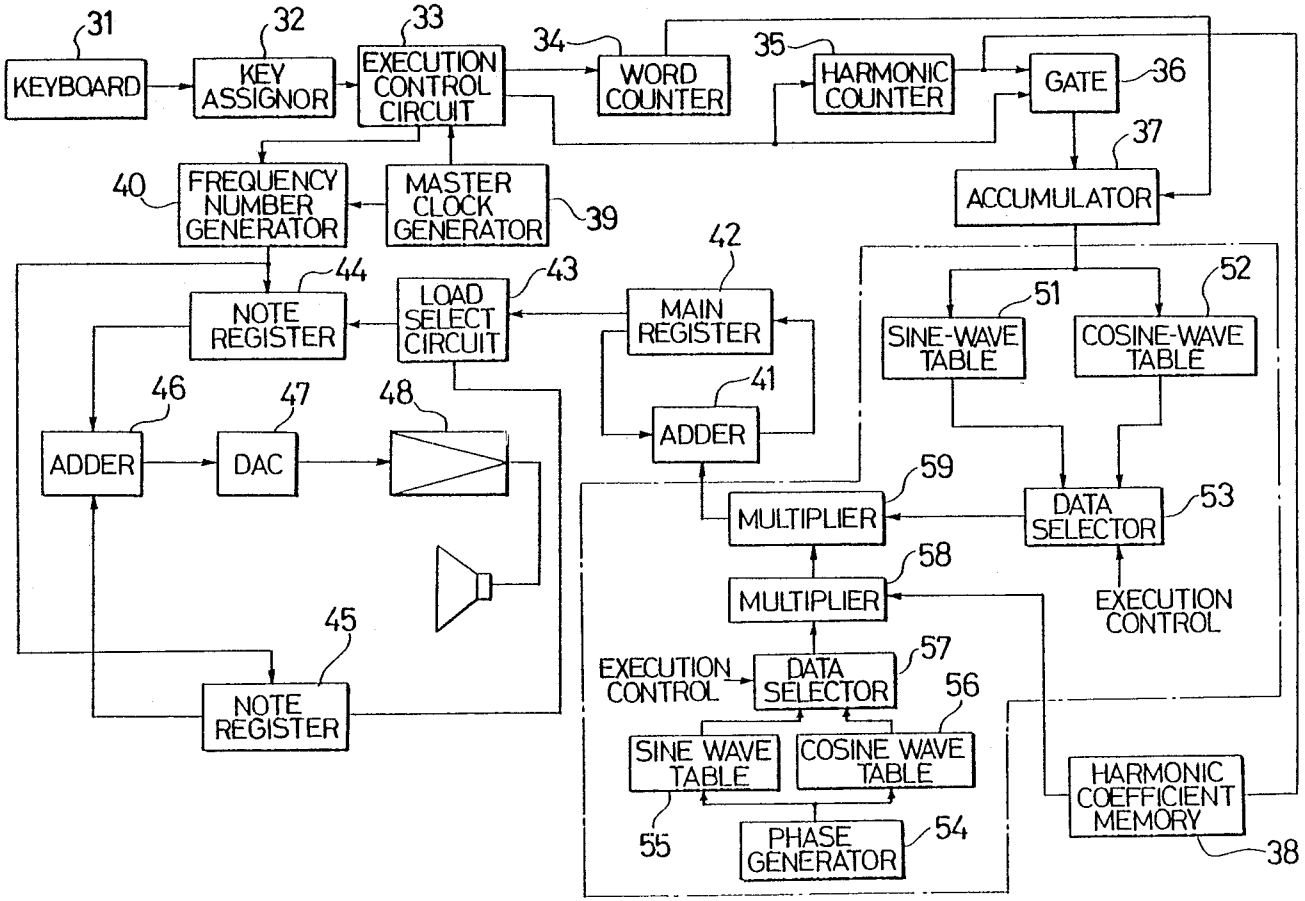
FIG. 4 is an example of an application of the present invention.

FIG. 4 illustrates, by way of example, an application of the embodiment depicted in FIG. 3. The electronic musical instrument used in this example is one that has applied the arrangement of the present invention, surrounded by the one-dot chain line, to a complex tone synthesizer proposed by R. Deutch et al. in Japanese Patent Application Public Disclosure No. 27621/77.

This example is adapted for conversion into a musical tone through use of a calculation cycle and a data transfer cycle so as to synthesize a main data set which is calculated by a Fourier series.

Upon depression of a key on a keyboard 31, a key signal is detected by a key assignor 32 and assigned to a channel, thereafter being provided to an execution control-circuit 33. The execution control-circuit 33 is placed under control of clock pulses from a master clock generator 39 to provide the timing of a calculation cycle in which to calculate harmonics for a main data set and a transfer cycle in which to transfer the calculated data and the timing for a frequency number generator 40 to generate frequencies corresponding to notes in note registers 44 and 45 which are to be converted into musical tones.

An arrangement for executing the calculation cycle in accordance with the timing from the execution control-circuit 33 comprises a word counter 34 for counting the number of words in the main data set, a harmonic counter 35 for counting the harmonic order and an accumulator 37 to which the output of the harmonic counter 35 and the timing from the execution control circuit 33 are applied via a gate 36, together with the output of the word counter 34, whereby calculation subcycles are accumulated in accordance with the contents of the word counter 34 (for example, modulo-32).

The accumulated value from the accumulator 37 is provided via the arrangement of the present invention in the one-dot chain line block to a main register 42, wherein it is stored as transfer data for the subsequent stage. In accordance with the accumulated value from the accumulator 37 sine waves or cosine waves are read out of a sine-wave table 51 or cosine-wave table 52 into a data selector 53, wherein any one of them is selected at the timing from the execution control-circuit 33. The selected data is sent to a multiplier 59. On the other hand, in order to create an inharmonic tone according to the present invention, a phase generator 54 determines the degree of phase of sine or cosine waves and sine waves or cosine waves are read out of a sine-wave table 55 or cosine-wave table 56 into a data selector 57, wherein any one of them is selected at the timing from the execution control-circuit 33. The selected data is applied to a multiplier 58, wherein it is multiplied by data read out by the output of a harmonic counter 35 from a harmonic memory 38, thus determining the amplitude of each harmonic. Next, in the multiplier 59, the sine wave or cosine wave selected by the data selector 53 is multiplied by a modulated wave of the sine or cosine wave delivered from the multiplier 58. By this, the modulated wave g(t) or h(t) given by the expression (2) or (3) is obtained and is sent to an adder 41, from which it is set in the main register 42 for storing transfer data.

Next, in a first one of two subcycles into which the transfer cycle is divided, the transfer data by which the over tones is provided from the main register 42 to the note register 44 which is selected by a load select circuit 43 and in which it is temporary stored. The data is converted by the frequency number generator 40 to a frequency corresponding to the note in the note register 44. The converted output is provided via an adder 46 to a D/A converter 47, by which it is converted to analog form for input into a sound system via an amplifier 48. On the other hand, the transfer data of the next subcycle of the calculation cycle is provided from the main register 42, in a second subcycle of the transfer cycle, to the note register 45 which is selected by the load select circuit 43 and wherein it is temporarily stored. The data is converted by the frequency number generator 40 to a frequency corresponding to the note in the note register 45. The converted output is applied to the sound system 49 via the same route as mentioned above.

In this way, data calculated by a calculation subsystem is added to an inharmonic tone and then stored in the main register 42, the contents of which are selectively transferred to the note register 44 and 45 for input into the sound system.

As described above, the electronic musical instrument of the present invention is provided with a means for generating the harmonic function corresponding to a harmonic, a means for generating a phase function which causes an arbitrary frequency difference in the harmonic tones and a means for multiplying the harmonic function and the phase function, whereby an arbitrary inharmonic tone can be created. According to the present invention, a tone close to a natural tone of an acoustic musical instrument can be produced with a relatively low-cost arrangement.

It will be apparent that many modifications and variations may be effected without departing from the scope of the novel concepts of the present invention.

What is claimed is:

1. An electronic musical instrument which synthesizes a musical waveform having inharmonics by computing each harmonic function corresponding to a first harmonic frequency, comprising:

(a) amplitude coefficient generating means for generating an amplitude coefficient $A_K$ corresponding to each harmonic, where K is an integer from 1 to n, n being an arbitrary integer;

(b) harmonic function generating means for generating harmonic functions sin $K\omega_0 t$ and cos $K\omega_0 t$, where $\omega_0$ is the first harmonic frequency and t is time;

(c) phase function generating means for generating phase functions cos $\Delta\omega_K t$ and sin $\Delta\omega_K t$, where $\Delta\omega_K$ is an arbitrary frequency which differs from the first harmonic frequency; and (d) calculating means for calculating the amplitude coefficients, harmonic functions and phase functions, the calculating means including:

first multiplying means for multiplying the amplitude coefficient $A_K$, the harmonic function sin $k\omega_0 t$ and the phase function cos $\Delta\omega_K t$ together;

second multiplying means for multiplying the amplitude coefficient $A_K$, the harmonic function cos $K\omega_0 t$ and the phase function sin $\Delta\omega_K t$ together; first accumulating means for accumulating the output of the first multiplying means to obtain $$\sum_{K=1}^{n} A_K \cdot \sin K\omega_0 t \cdot \cos\Delta\omega_K t;$$

second accumulating means for accumulating the output of the second multiplying means to obtain $$\sum_{K=1}^{n} A_K \cdot \cos K\omega_0 t \cdot \sin\Delta\omega_K t;$$

and adding means for adding the outputs of the first and second accumulating means together;

whereby the following equation is computed $$Z = \sum_{K-1}^{n} A_K \cdot \sin K\omega_0 t \cdot \cos\Delta\omega_K t +$$

-continued $$\sum_{K=1}^{n} A_K \cdot \cos K\omega_0 t \cdot \sin\Delta\omega_K t$$

permitting the synthesization of a musical waveform which has first to Kth harmonics and inharmonics, each having the arbitrary frequency difference $\Delta\omega_K$ from the corresponding one of the first to Kth harmonics.

2. The electronic musical instrument of claim 1, wherein there are provided at the output side of each of the first and second accumulating means (a) transfer control means for transferring the accumulated output of the accumulating means, (b) waveform storage means for storing the accumulated output from the transfer control means, and (c) frequency generating means for reading out the waveform information stored in the waveform storage means, under control of the trasfer control means, whereby it is possible to synthesize a musical waveform whih has harmonics for a scale frequency corresponding to each key of a keyboard and inharmonics, each having the arbitrary frequency difference ($\Delta\omega_K$) from the corresponding one of the harmonics.

3. An electronic musical instrument which synthesizes a musical waveform having inharmonics by computing each harmonic function and each phase function corresponding to a fundamental wave, comprising:

(a) harmonic function generating means for generating harmonic functions sin $K\omega_0 t$ and cos $K\omega_0 t$, where K is an integer from 1 to n, n being an arbitrary integer, $\omega_0$ is the fundamental wave and t is time;

(b) means for reading out the harmonic functions from the harmonic function generating means;

(c) phase function generating means for generating phase functions cos $\Delta\omega_K t$, where $\Delta\omega$ is an arbitrary frequency which differs from the frequency of the fundamental wave;

(d) means for reading out the phase functions from the phase function generating means;

(e) harmonic coefficient generating means for generating harmonic coefficients;

(f) main register means for storing transfer data;

(g) multiplying means for multiplying together the harmonic functions from the harmonic function generating means, the phase functions from the phase function generating means and the harmonic coefficients from the harmonic coefficient generating means;

(h) adder means for adding the multiplied output from the multiplying means and data in the main register means, said register receiving data from said adder, said adder means for multiplying the added output from said main register means by the next multiplied output from said multiplying means;

whereby it is possible to synthesize a musical waveform which has harmonics corresponding to the fundamental wave and inharmonics, each having the arbitrary frequency difference ($\Delta\omega_K$) from the corresponding one of the harmonics.

4. The electronic musical instrument of claim 3, wherein (a) the harmonic function generating means comprises a sine wave table (for generating sin $K\omega_0 t$), a cosine wave table (cos $K\omega_0 t$), and a first data selector for selecting either one of the outputs of the sine wave table and the cosine wave table, (b) the phase function generating means comprises a cosine wave table (for generating cos $\Delta\omega_K t$) and a sine wave table (for generating sin $\Delta\omega_K t$), and a second data selector for selecting either one of the outputs of the cosine wave table and the sine wave table, and (c) the multiplying means comprises a first multiplier for multiplying the phase function which is the output of the second data selector and the harmonic coefficient and a second multiplier for multiplying the output of the first multiplier and the harmonic function which is the output of the first data selector, and wherein the first and second data selectors each select the sine wave table and the cosine wave table alternately with each other, thereby synthesizing the musical waveform having inharmonics.

* * * * *